US010844618B2

(12) United States Patent
White

(10) Patent No.: US 10,844,618 B2
(45) Date of Patent: Nov. 24, 2020

(54) ADJUSTABLE SUPPORT

(71) Applicant: FAST-FORM SYSTEMS LTD, Cleethorpes (GB)

(72) Inventor: Tony White, Cleethorpes (GB)

(73) Assignee: Fast-Form Systems Ltd, Cleethorpes (GB)

( * ) Notice: Subject to any disclaimer, the term of this patent is extended or adjusted under 35 U.S.C. 154(b) by 1 day.

(21) Appl. No.: 14/916,041

(22) PCT Filed: Aug. 22, 2014

(86) PCT No.: PCT/GB2014/052586
§ 371 (c)(1),
(2) Date: Mar. 2, 2016

(87) PCT Pub. No.: WO2015/033109
PCT Pub. Date: Mar. 12, 2015

(65) Prior Publication Data

US 2016/0194887 A1 Jul. 7, 2016

(30) Foreign Application Priority Data

Sep. 3, 2013 (GB) ..... 1315630.2

(51) Int. Cl.
*E04G 17/14* (2006.01)
*E04G 21/32* (2006.01)
(Continued)

(52) U.S. Cl.
CPC ..... *E04G 17/14* (2013.01); *E04G 5/062* (2013.01); *E04G 17/002* (2013.01); *E04G 17/12* (2013.01); *E04G 21/3204* (2013.01)

(58) Field of Classification Search
CPC ..... E04G 17/14; E04G 21/3204; E04G 17/12; E04G 5/062; E04G 17/002
See application file for complete search history.

(56) References Cited

U.S. PATENT DOCUMENTS 1,495,305 A 5/1924 Heltzel
1,527,698 A 2/1925 Pearthree
(Continued)

FOREIGN PATENT DOCUMENTS

CA 1329492 C 5/1994
CA 2957857 A1 3/2015
(Continued)

OTHER PUBLICATIONS

GB Search Report dated Jul. 7, 2015 of Patent Application No. GB1500178.7, 8 pages.
(Continued)

*Primary Examiner* — John C Hong
(74) *Attorney, Agent, or Firm* — Maine Cernota & Rardin

(57) ABSTRACT

An adjustable support for use in shuttering formwork comprising a base member, a shuttering contact member, and a bracing member, wherein the base member, the shuttering contact member and the bracing member are engaged hingedly with one another. The bracing member is engaged securably with the shuttering contact member and the base member. The bracing member is adjustable, such that adjustment of the bracing member causes rotation of the shuttering contact member about the base member. Also disclosed is a method for supporting shuttering comprising providing one or more adjustable supports as described above, affixing the or each base member to a substantially static object, assembling the or each bracing member and the or each shuttering contact member as described above, adjusting the or each bracing member and attaching the or each shuttering to the or each shuttering contact member.

16 Claims, 3 Drawing Sheets

(51) Int. Cl.

| | |
|---|---|
| ***E04G 17/12*** | (2006.01) |
| ***E04G 17/00*** | (2006.01) |
| ***E04G 5/06*** | (2006.01) |

(56) References Cited

U.S. PATENT DOCUMENTS

| | | | | |
|---|---|---|---|---|
| 1,652,480 | A | 12/1927 | Hutchins | |
| 1,770,518 | A | 7/1930 | Harrold | |
| 1,939,007 | A | 12/1933 | Heltzel | |
| 2,251,775 | A | 8/1941 | Artil | |
| 2,482,367 | A | 9/1949 | Ravers, Jr. | |
| 2,626,444 | A | 1/1953 | Wolf | |
| 2,661,516 | A | 12/1953 | Yates | |
| 2,663,925 | A | 12/1953 | Yates | |
| 2,722,045 | A | 11/1955 | Yates | |
| 2,731,700 | A | 1/1956 | Yates | |
| 2,741,821 | A | 4/1956 | Findley | |
| 2,843,911 | A | 7/1958 | Maine | |
| 2,846,748 | A | 8/1958 | Owen | |
| 2,917,803 | A | 12/1959 | Phillips | |
| 3,035,321 | A | 5/1962 | Hennig | |
| 3,242,833 | A | 3/1966 | Sondheim | |
| 3,428,287 | A | 2/1969 | Redding et al. | |
| 4,579,312 | A | 4/1986 | White | |
| 4,659,054 | A | 4/1987 | Allen | |
| 4,690,367 | A | 9/1987 | Weathers | |
| 4,712,764 | A | 12/1987 | White | |
| 4,824,068 | A | 4/1989 | Ferland | |
| 4,921,204 | A | 5/1990 | Melfi | |
| 4,996,770 | A | 3/1991 | McCracken | |
| 5,076,536 | A | 12/1991 | Fitzgerald | |
| 5,096,155 | A | 3/1992 | Fitzgerald | |
| 5,261,635 | A | 11/1993 | Flathau | |
| 5,575,938 | A * | 11/1996 | Ono | E04G 9/02 249/189 |
| 5,817,247 | A | 10/1998 | Colatruglio | |
| 6,367,764 | B1 | 4/2002 | Butler | |
| 6,536,737 | B1 | 3/2003 | Davis | |
| 6,918,567 | B2 | 7/2005 | Ward | |
| 7,303,361 | B1 | 12/2007 | Lane | |
| 7,832,705 | B2 | 11/2010 | Spencer | |
| 7,841,576 | B2 | 11/2010 | Miller | |
| 8,028,476 | B1 | 10/2011 | Alford | |
| 8,215,608 | B2 | 7/2012 | Oleson | |
| 8,919,726 | B2 | 12/2014 | Hendricks | |
| 9,328,469 | B2 | 5/2016 | Radu, Jr. | |
| 2002/0073634 | A1 * | 6/2002 | Bolinger | E04G 3/20 52/127.2 |
| 2002/0195536 | A1 | 12/2002 | Flathau | |
| 2003/0146365 | A1 | 8/2003 | Miller | |
| 2006/0201743 | A1 | 9/2006 | Dell'Erba et al. | |
| 2012/0155960 | A1 | 6/2012 | Lowery | |
| 2017/0292280 | A1 | 10/2017 | White | |
| 2017/0370099 | A1 | 12/2017 | Chevis | |
| 2018/0073259 | A1 | 3/2018 | Johnson | |
| 2018/0298625 | A1 | 10/2018 | White | |
| 2019/0194887 | A1 | 6/2019 | Kim | |

FOREIGN PATENT DOCUMENTS

| | | | |
|---|---|---|---|
| CN | 202064630 | U | 12/2011 |
| DE | 2142150 | A1 | 3/1972 |
| DE | 4000400 | A1 | 7/1991 |
| DE | 202006019268 | U1 | 5/2007 |
| EP | 3169857 | A1 | 5/2017 |
| EP | 3042009 | A1 | 7/2019 |
| FR | 1557938 | A | 2/1969 |
| FR | 2527711 | A1 | 12/1983 |
| FR | 2542789 | A1 | 9/1984 |
| FR | 2671575 | * | 2/1994 |
| FR | 2835554 | A1 | 8/2003 |
| FR | 2884536 | A1 | 10/2006 |
| GB | 696260 | A | 8/1953 |
| GB | 762382 | A | 11/1956 |
| GB | 770446 | A | 3/1957 |
| GB | 787200 | A | 12/1957 |
| GB | 807681 | A | 1/1959 |
| GB | 2508263 | A | 5/2014 |
| GB | 2533172 | A | 6/2016 |
| GB | 2539371 | A | 12/2016 |
| GB | 2556866 | A | 6/2018 |
| GB | 2561567 | A | 10/2018 |
| GB | 6054088 | | 2/2019 |
| GR | 1004120 | B | 1/2003 |
| JP | 01105867 | A | 4/1989 |
| JP | H01105867 | A | 4/1989 |
| JP | H07300856 | A | 11/1995 |
| JP | 01061181 | A | 3/1998 |
| JP | H1061181 | A | 3/1998 |
| WO | 9203626 | A1 | 3/1992 |
| WO | 9214015 | A1 | 8/1992 |
| WO | 9420694 | A1 | 9/1994 |
| WO | 2007024883 | A2 | 3/2007 |
| WO | 2013016760 | A1 | 2/2013 |
| WO | 2015033109 | A1 | 3/2015 |
| WO | 2016110663 | A | 7/2016 |
| WO | 2018055323 | A1 | 3/2018 |

OTHER PUBLICATIONS

International Search Report and Written Opinion, dated Dec. 17, 2015 of Patent Application No. PCT/GB2015/053233 filed Oct. 28, 2015, 12 pages.

PCT Search Report & Written Opinion for Appl No. PCT/GB2017/052022 dated Oct. 5, 2017, 13 pages.

PCT/GB2019/050329—Has not yet published—Application as filed has been used for reference.

Office Action for U.S. Appl. No. 16/334,824, dated Jun. 25, 2020, 25 Pages.

* cited by examiner 10
42
34
32
40
30
22
20
24

54
52
50
30
10
40
20

ADJUSTABLE SUPPORT

RELATED APPLICATIONS

This application is a national phase application filed under 35 USC § 371 of PCT Application No. PCT/GB2014/052586 with an International filing date of 22 Aug. 2014, which claims priority of GB Patent Application 1315630.2 filed 3 September. Each of these applications is herein incorporated by reference in their entirety for all purposes.

FIELD OF THE INVENTION

The present invention relates to supports for use in shuttering formwork, in particular to adjustable supports and to methods for supporting shuttering.

BACKGROUND TO THE INVENTION

Shuttering or formwork used typically for smaller base, wall, ground beams and the like within the construction industry has conventionally required the construction of bespoke timber shutters and generally also timber supports/strutting to retain concrete materials or the like. These supports cannot readily be reused on different construction projects as dimensions and sizes often vary and generally the timber shutters will not have a very long life span, are costly to make in terms of timber and man hours and also costly to dismantle and dispose of at the end of a project As such, after use the timber is wasted and its disposal is not only costly but not environmentally friendly.

More extensive metal shuttering systems are in use currently but these are complex to erect and are both heavy and expensive and are usually not suitable for smaller or very complex structures, further more they are not flexible enough for radius work or sheet piling applications and are also only suitable for vertical work, they have no flexibility for movement in the vertical plane. Furthermore they have limited functionality and are thus not applicable for some types of concrete moulding as described.

Moreover most of the conventional systems, timber shutters especially, do not allow full access to the form-work being constructed. Once over a certain height this then forces the user into unsafe modes of operation.

There has now been developed an adjustable support for use in shuttering formwork which overcomes or substantially mitigates the above-mentioned and/or other disadvantages associated with the prior art.

SUMMARY OF THE INVENTION

According to a first aspect of the invention there is provided an adjustable support for use in shuttering formwork comprising, a base member, a shuttering contact member, and a bracing member, wherein:

the base member, shuttering contact member and bracing member are engaged hingedly with one another;

the bracing member is engaged securably with the shuttering contact member and the base member;

the bracing member is adjustable, in use, thereby causing rotation of the shuttering contact member about the base member; and the bracing member engages slidingly with the shuttering contact member and/or the base member.

According to a further aspect of the invention there is provided a method for supporting shuttering comprising providing one or more adjustable supports as described herein, affixing the or each base member to a substantially static object, attaching the or each shuttering to the or each shuttering contact member and adjusting and securing the or each bracing member.

The support and method according to the invention are advantageous principally because the shuttering contact member engages hingedly with the base member, and the bracing member is adjustable, such that adjustment of the bracing member causes rotation of the shuttering contact member about the base member. This design means that the support can be manufactured from lighter materials than conventional wooden or metal apparatus. Furthermore it means that the support can be erected quickly (whilst conforming to manual handling regulations), and the angle of the shuttering contact member with respect to the base member can be adjusted easily and effectively. The support is therefore particularly useful for moulding concrete or the like with both angular and vertical edge portions, perhaps from uneven surfaces and eliminating timber waste.

The support and method according to the invention are further advantageous because it is capable of being collapsed/flat packed after use, and then reused for a separate shuttering/formwork, perhaps requiring alternative dimensions and angles.

In a preferred embodiment of the invention the hinged engagement of the base member, the bracing member and the shuttering contact member with one another preferably enables rotation of the members about one another. The bracing member is preferably engaged securably with the shuttering contact member and the base member. The securable engagement preferably also enables the spacial orientation of the members to be fixed substantially with one another. The base member can also be engaged securably in substantially the same manner with the shuttering contact member. Examples of suitable engagements include a threaded bolt and nut assembly or a locking pin assembly or the like. The engagements can also preferably be completely disassembled allowing disassociation of each of the members from one another, for example for the purposes of transport.

The bracing member preferably engages with a longitudinal slot defined within the shuttering contact member, the base member or both. In this embodiment the rotation of the shuttering contact member about the base is preferably effected by sliding the bracing member within the shuttering contact member and/or the base member.

In another embodiment the bracing member preferably comprises a telescopic portion. Preferably the telescopic portion comprises a hydraulic portion, a pneumatic portion, a bar extendable within a tubular surround, or the like. Preferably, rotation of the shuttering contact member about the base is effected by extension or retraction of the telescopic portion.

In another embodiment the bracing member preferably comprises a screw jack or the like. Preferably, the rotation of the shuttering contact member about the base is effected by operation of the screw jack or the like.

Preferably the shuttering contact member and/or the base member are adapted for attachment to shuttering and/or pile. The shuttering contact member and/or the base member can therefore be formed with openings to allow screws, nails or bolts to be used in attachment of the shuttering and/or pile.

The contact member and/or the base member can also comprise a substantially flat surface to allow abutment of the shuttering and/or pile. The contact member and/or the base member can also attach to shuttering and/or pile via slot and hook arrangements. The shuttering contact member and/or the base member can also attach to shuttering and/or pile by adhesion.

Preferably the shuttering and/or pile is a formed as a sheet of material. More preferably the material comprises wood, plastics, composite and/or metal. Examples of suitable materials include ply wood sheets, weather board sheets or scaffold boards.

In a preferred embodiment, the adjustable support according to the invention is preferably collapsible. Preferably the base member, shuttering contact member and the bracing member are all or partly dissociated from one another to enable rotation of the members about one another. In this way the support is preferably capable of forming a substantially flat object.

In a further embodiment of the invention the adjustable support is preferably adapted for attachment of a rail, a platform, or both. The rail preferably comprises a hand rail or the like. The rail preferably forms a guard for safe access to the support. Examples of suitable rails include rails made from scaffolding tubes or timber or the like. The platform preferably comprises substantially flat surface or the like. The platform preferably forms an access platform to allow human passageway around the support. Examples of suitable platforms include those made from sheet boarding and/or steel supports. Preferably the platform is supported by the shuttering contact member. In an embodiment of the invention wherein the base member is attached to a pile, the shuttering contact member forms a platform.

Preferably the rail is supported by the shuttering contact member, the platform, or both.

Preferably, the base member according to the invention is adapted to be affixed to a substantially static object to prevent the support from moving substantially in use. The base member can therefore comprise openings to allow it to be screwed, nailed or bolted to the floor or other substantially static object. The base member can also be adhered to the floor or other substantially static object, for example a pile.

The adjustable support according to the invention is advantageous in that it is capable of adopting an alternate orientation such that instead of it being used as a support for shuttering/formwork/pile work, it can be supported by the shuttering/formwork/pile work.

The support and method according to the invention are therefore further advantageous as they allow full access, in line with health and safety requirements, to all areas of the shuttering/formwork and/or the material behind them.

It will be appreciated that the support according to the invention can be used in combination with parts of the support according to the invention. The support according the invention can therefore comprise a second bracing member, and a second shuttering support member. Advantageously therefore only one complete support according to the invention is required when used in shuttering/form work with two sided walls.

A preferred embodiment of the invention will now be described in greater detail, by way of illustration, with reference to the accompanying drawing.

DETAILED DESCRIPTION OF THE ILLUSTRATED EMBODIMENT

Figure 1:
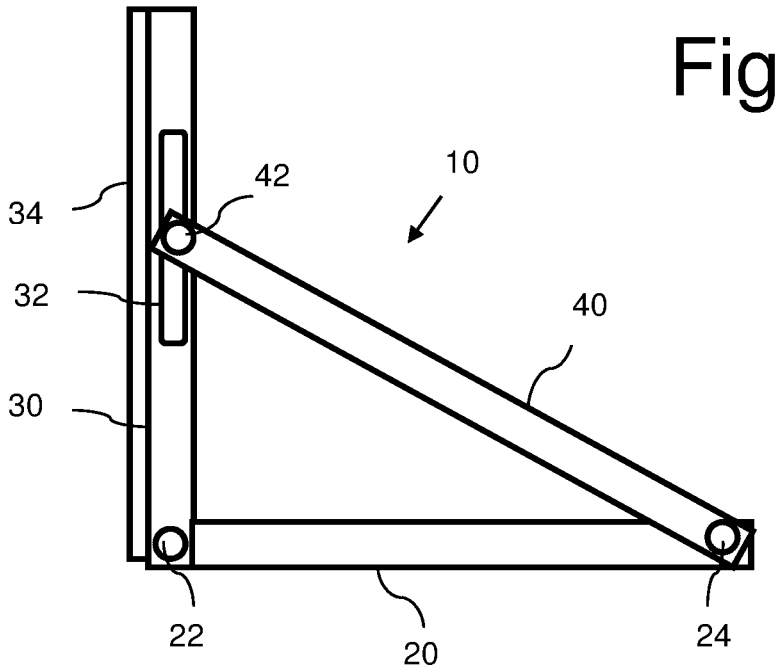
FIG. 1 is a schematic side view of an embodiment of an adjustable support according to the invention.

FIG. 1 shows an adjustable support according to the invention generally designated 10 comprising a base member 20, a shuttering support member, 30 and a bracing member 40. The base member 20 has a hinge 22 at one end which engages with one end of the shuttering support member 30. The hinge 22 is a nut and bolt arrangement, with the bolt inserted through openings in the base member 20 and the shuttering support member 30. At the other end of the base member 20 is a second hinge 24 which engages in substantially the same way as hinge 22, but with one end of the bracing member 40. The other end of the bracing member 40 engages with longitudinal slot 32 in the shuttering support member 30. The bracing member 40 also has a fixture 42 which is a bolt and nut arrangement which extends though the slot 32 and retains the bracing member 40 in place. Hinges 22 and 24 and fixture 42 are all allowed to pivot freely.

Each member 20, 30 and 40 is of a steel merchant bar construction. However other materials can be used for additional weight saving. Other materials include other metals, plastics, wood or composites.

In use the members 20, 30 and 40 are attached together as shown in FIG. 1 to form a support 10 which when erected generally forms the shape of a triangular bracket. The support 10 is held by the base member 20 which is held in a substantially static orientation by bolts which are inserted through the base member 20 and into the ground. The base member 20 can therefore include guide holes for this purpose. A shuttering board 34 is attached to the shuttering contact member 30. In this example the board is a plywood board and the fixture is by screwing. The bracing member 40 is then adjusted within the slot 32 to cause the rotation of the member 30 about the base member 20. It will be appreciated that multiple angles can be achieved but in this example the bracing member is moved to achieve a vertical plumb line for shuttering. The support 10 is then secured by tightening the nut and bolt assemblies at hinges 22, 24 and fixture 24.

The movement of the support contact member 30 compensates for uneven ground and allows plumbing forward or backward by moving the bracing member 40 up or down.

Multiple supports 10 can be used in combination when shuttering/formwork is required for large areas and to define different shapes.

After use the nut and bolt assemblies at hinges 22, 24 and fixture 24 are released and the support 10 is collapsed and flat packed.

Figure 2:
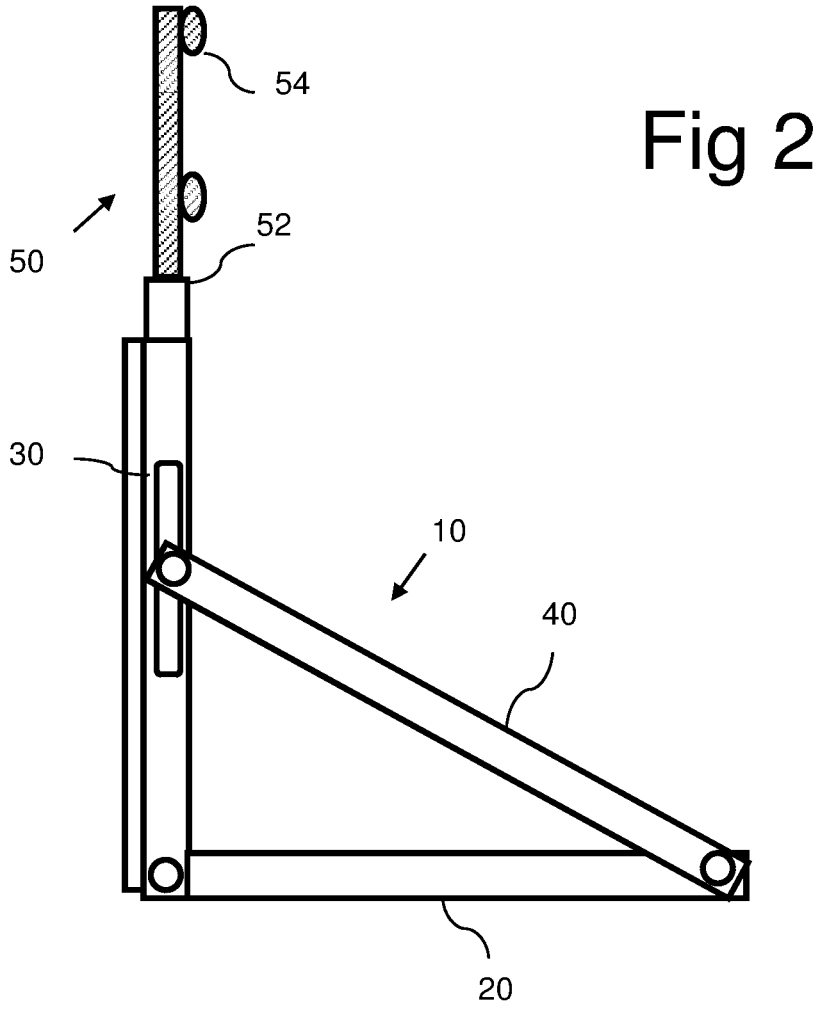
FIG. 2 is a schematic side view of an embodiment of an adjustable support according to the invention, showing guard rail.

FIG. 2 shows a guard rail generally designated 50 supported by the shuttering support member 30 of the support 10. The guard rail 50 comprises a rail attachment 52 and a combination of vertical and horizontal scaffolding tubes 54.

Figure 3:
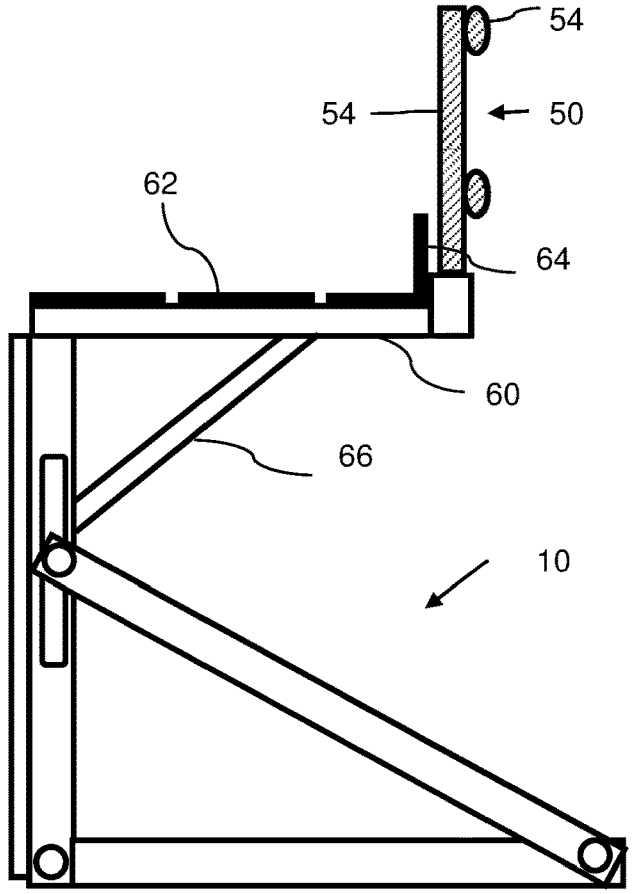
FIG. 3 is a schematic side view of an embodiment of an adjustable support according to the invention, showing guard rail and access platform

FIG. 3 shows a guard rail generally designated 50 supported by an access platform 60. The access platform 60 is supported by the shuttering support member 30 of the support 10. The guard rail 50 comprises a rail attachment 52 and a combination of vertical and horizontal scaffolding tubes 54. The access platform 60 comprises standard scaffolding boards 62 and optionally a kicker board 64. There is also a bracket member 66 which serves as extra support for the access platform 60 and guard rail 50.

Figure 4:
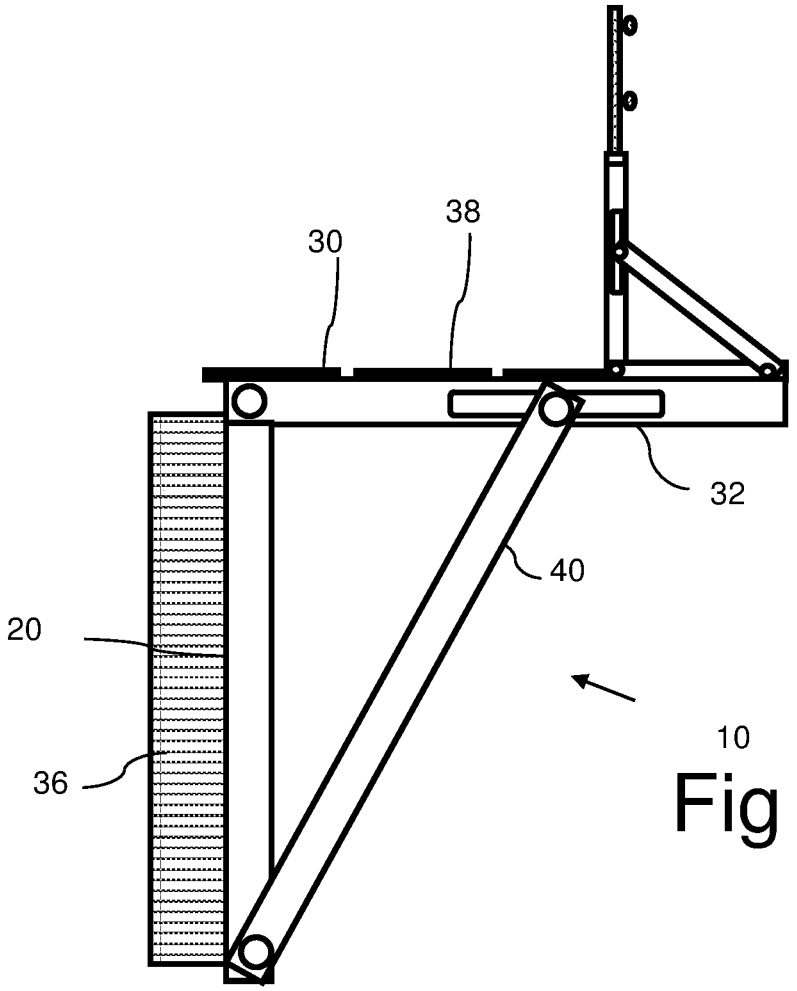
FIG. 4 is a schematic side view of an embodiment of an adjustable support according to the invention, showing a guard rail and access platform and attachment to sheet pile.

FIG. 4 shows an embodiment of the invention whereby the support 10 is attached to a sheet pile via the base member 20. The arrangement of the support 10 is otherwise the same as described in the embodiment of FIG. 1, however in this example the shuttering support member 30 is adapted to support plywood or scaffolding board 38 which serves as an access platform as described above. An optional hand rail can be fitted as shown. In use the pile 36 is inserted into the ground and the base member 20 affixed to it. The bracing member 40 is then adjusted within the slot 32 until the desired angle for the shuttering support member 30 (serving as an access platform) is achieved. The support is then locked in place as described earlier.

Figure 5:
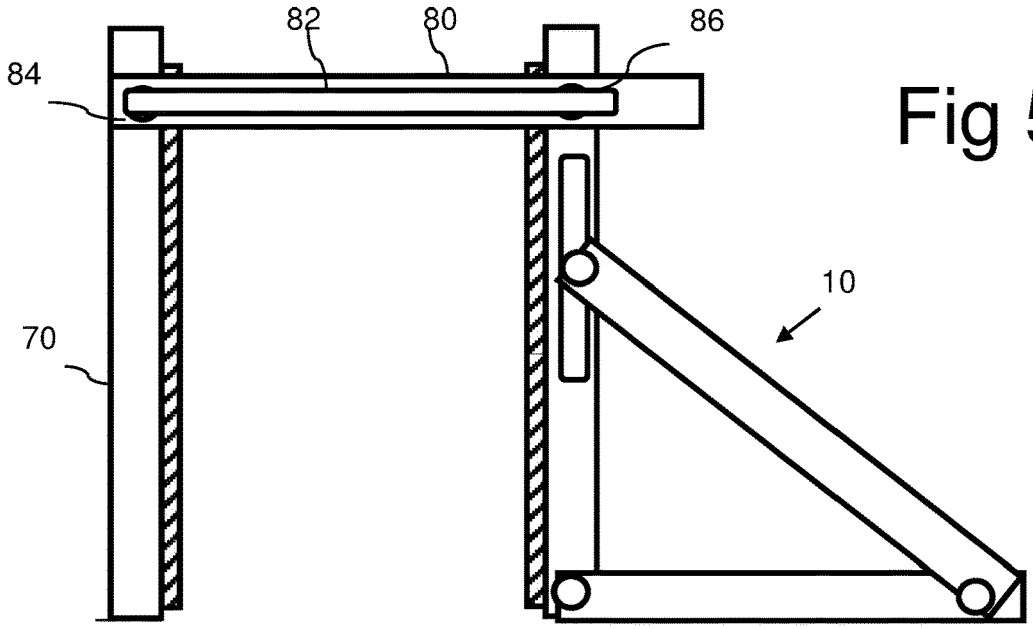
FIG. 5 is a schematic side view of an embodiment of an adjustable support according to the invention used in two sided shuttering/formwork.

FIG. 5 shows an embodiment of an adjustable support according to the invention used in two sided shuttering/formwork. The support 10 is formed as described above to support shuttering for one side of a wall. A second shuttering contact member 70 is placed in the position required for the second side of the wall. The second shuttering contact member 70 is affixed to the ground using a bracket plate or bolt or the like (not shown). The bracket plate comprises a plate with a projecting portion. The projecting portion mutually engages with the second shuttering contact member. The engagement prevents lateral movement of the second shuttering contact member with respect to the bracket or the ground, but allows substantial pivotal movement of the second shuttering contact member about the bracket and/or the ground. A second bracing member 80 is applied to the structure as shown and adjusted so as to control the angles required for the walls. This is achieved by making the second bracing member 80 with a slot 82 for receiving the linkages 84 and 86.

The invention claimed is:

1. An adjustable support for use in shuttering formwork, comprising:

a base member;

a shuttering contact member; and a fixed-length bracing member;

wherein:

the base member, shuttering contact member and bracing member are engaged hingedly with one another, the bracing member is engaged securably with the shuttering contact member and the base member, the bracing member engages slidingly with the shuttering contact member and/or the base member, the bracing member engages with a longitudinal slot in the shuttering contact member, the bracing member comprises a fixture which is a bolt and nut arrangement which extends through the slot and retains the bracing member in place, the fixture being allowed to pivot freely, the bracing member is adjustable within the slot to cause rotation of the shuttering contact member about the base member, and the shuttering contact member and/or the base member comprises a substantially flat surface to which a shuttering board and/or pile formed as a sheet of material is attached, said fixture is configured to secure said bracing member in a fixed position relative to said slot and said shuttering contact member by the tightening of said bolt and nut arrangement such that said nut directly engages said shuttering contact at said slot, and said adjustable support is collapsible and configured such that when disposed in a collapsed position, said base member, said shuttering contact member, and said bracing member are substantially parallel to each other.

2. The adjustable support according to claim 1, wherein the bracing member comprises a threaded bar which engages with an angular portion of the base member.

3. The adjustable support according to claim 2, wherein rotation of the shuttering contact member about the base is effected by tightening or loosening one or more nuts disposed on the bar around the angular portion of the base member.

4. The adjustable support according to claim 1, wherein the bracing member comprises a telescopic portion.

5. The adjustable support according to claim 4, wherein rotation of the shuttering contact member about the base is effected by extension or retraction of the telescopic portion.

6. The adjustable support according to claim 1, wherein the bracing member comprises a screw jack.

7. The adjustable support according to claim 6, wherein the rotation of the shuttering contact member about the base is effected by operation of the screw jack.

8. The adjustable support according to claim 1, wherein the shuttering contact member and/or the base member is adapted for attachment to shuttering and/or pile.

9. The adjustable support according to claim 1 adapted for attachment of a rail, a platform, or both.

10. The adjustable support according to claim 9, wherein the platform is supported by the shuttering contact member.

11. The adjustable support according to claim 9, wherein a guard rail is supported by the shuttering contact member, the platform, or both.

12. The adjustable support according to claim 1, wherein the base member is adapted for attachment to a pile and the shuttering contact member forms a platform.

13. The adjustable support according to claim 1, wherein the base member is adapted to be affixed to a substantially static object to prevent the support from moving substantially in use.

14. The adjustable support according to claim 1, comprising a second bracing member and a second shuttering support member.

15. The adjustable support according to claim 14, for use in shuttering/form work with two sided walls.

16. A method for supporting shuttering comprising providing one or more adjustable supports as defined in claim 1, affixing the or each base member to a substantially static object, attaching the or each shuttering to the or each shuttering contact member, and adjusting and securing the or each bracing member.

* * * * *